US010801374B2

(12) United States Patent
Toyota et al.

(10) Patent No.: US 10,801,374 B2
(45) Date of Patent: Oct. 13, 2020

(54) VALVE TIMING ADJUSTMENT DEVICE

(71) Applicant: MITSUBISHI ELECTRIC CORPORATION, Tokyo (JP)

(72) Inventors: Shohei Toyota, Tokyo (JP); Masayuki Yokoyama, Tokyo (JP); Tomoyuki Nishida, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/606,871

(22) PCT Filed: Jun. 1, 2017

(86) PCT No.: PCT/JP2017/020459

§ 371 (c)(1),
(2) Date: Oct. 21, 2019

(87) PCT Pub. No.: WO2018/220789

PCT Pub. Date: Dec. 6, 2018

(65) Prior Publication Data

US 2020/0131951 A1 Apr. 30, 2020

(51) Int. Cl.
*F01L 1/344* (2006.01)

(52) U.S. Cl.
CPC ... *F01L 1/3442* (2013.01); *F01L 2001/34483* (2013.01)

(58) Field of Classification Search
CPC ... F01L 2001/34483; F01L 1/34; F01L 1/344; F01L 1/3442; F01L 1/46
USPC ..... 123/90.15–90.17; D8/399; D21/759
See application file for complete search history.

(56) References Cited

U.S. PATENT DOCUMENTS 2,644,199 A * 7/1953 Miller ..... B29C 70/74 264/269
7,309,292 B2 * 12/2007 Tu Teng ..... A63B 69/3614 473/256
8,651,077 B2 * 2/2014 Matsunaga ..... F01L 9/02 123/90.17
9,581,055 B2 * 2/2017 Kandolf ..... F01L 1/3442
9,840,944 B2 * 12/2017 Hopkins ..... F01L 1/3442
2008/0171258 A1 * 7/2008 Takahashi ..... H01M 8/04208 429/447
2009/0188456 A1 * 7/2009 Dupuis ..... F01L 1/3442 123/90.17
2009/0211549 A1 * 8/2009 Myers ..... F01L 1/3442 123/90.17

(Continued)

FOREIGN PATENT DOCUMENTS

JP 5920632 B2 5/2016

*Primary Examiner* — Devon C Kramer
*Assistant Examiner* — Kelsey L Stanek
(74) *Attorney, Agent, or Firm* — Birch, Stewart, Kolasch & Birch, LLP

(57) ABSTRACT

A spiral spring (5) has an inner circumferential end (5*a*) fixed to a rotor (3) and an outer circumferential end (5*b*) fixed to a plate (8) of a housing (2), and biases the rotor (3) in one direction with respect to the housing (2). A projection (13) protrudes from the plate (8), and stops radially outward expansion of an outermost winding (5*c*) of the spiral spring (5). A clip (6) has a first portion (6*a*) coming in contact with the outermost winding (5*c*) of the spiral spring (5), and is attached to the projection (13) by elastic force of the clip (6).

9 Claims, 6 Drawing Sheets

(56) References Cited

U.S. PATENT DOCUMENTS

| | | | | |
|---|---|---|---|---|
| 2011/0073056 | A1* | 3/2011 | Kobayashi | F01L 1/3442 123/90.17 |
| 2015/0078859 | A1* | 3/2015 | Haines, Jr. | F16B 19/05 411/361 |
| 2016/0069223 | A1* | 3/2016 | Sakane | F01L 1/34 123/90.15 |
| 2017/0096916 | A1* | 4/2017 | Boese | F01L 1/3442 |
| 2018/0135475 | A1* | 5/2018 | Heilig | F01L 1/3442 |

* cited by examiner

VALVE TIMING ADJUSTMENT DEVICE

TECHNICAL FIELD

The present invention relates to a valve timing adjustment device including a spiral spring for biasing a rotor.

BACKGROUND ART

Some valve timing adjustment devices include a spiral spring that generates biasing force against reaction force applied to a camshaft from a valve. The spiral spring may expand radially outward owing to rotational movement of the valve timing adjustment device and vibration of an internal combustion engine, and then breakage of the spiral spring may occur. Thus, a valve timing adjustment device according to Patent Literature 1 includes stopper pins for stopping the outermost winding of the spiral spring from expanding radially outward.

CITATION LIST

Patent Literatures

Patent Literature 1: JP 5920632 B2

SUMMARY OF INVENTION

Technical Problem

The valve timing adjustment device of the related art, which is structured as described above, has a problem in which sliding movement of the spiral spring in line contact with the stopper pins causes the spiral spring and the stopper pins to wear.

The present invention has been made to solve such a problem as described above, and an object thereof is to reduce wear of a spiral spring and a stopper pin.

Solution to Problem

A valve timing adjustment device according to the present invention includes: a first rotary body including hydraulic chambers; a second rotary body having vanes each of which partitions a corresponding one of the hydraulic chambers into an advancing side and a retarding side, the second rotary body being rotatable relative to the first rotary body; a spiral spring having one end fixed to the second rotary body and another end fixed to the first rotary body, the spiral spring being to bias the second rotary body in one direction with respect to the first rotary body; a projection protruded from the first rotary body, for stopping radially outward expansion of an outermost winding of the spiral spring; and a clip having a first portion coming in contact with the outermost winding of the spiral spring, the clip being attached to the projection by elastic force of the clip.

Advantageous Effects of Invention

According to the present invention, the first portion of the clip, instead of the projection, comes in contact with the outermost winding of the spiral spring, which can reduce wear of the spiral spring and the projection.

DESCRIPTION OF EMBODIMENTS

An embodiment for carrying out the invention will now be described with reference to the accompanying drawings for more detailed explanation of the invention.

First Embodiment

Figure 1:
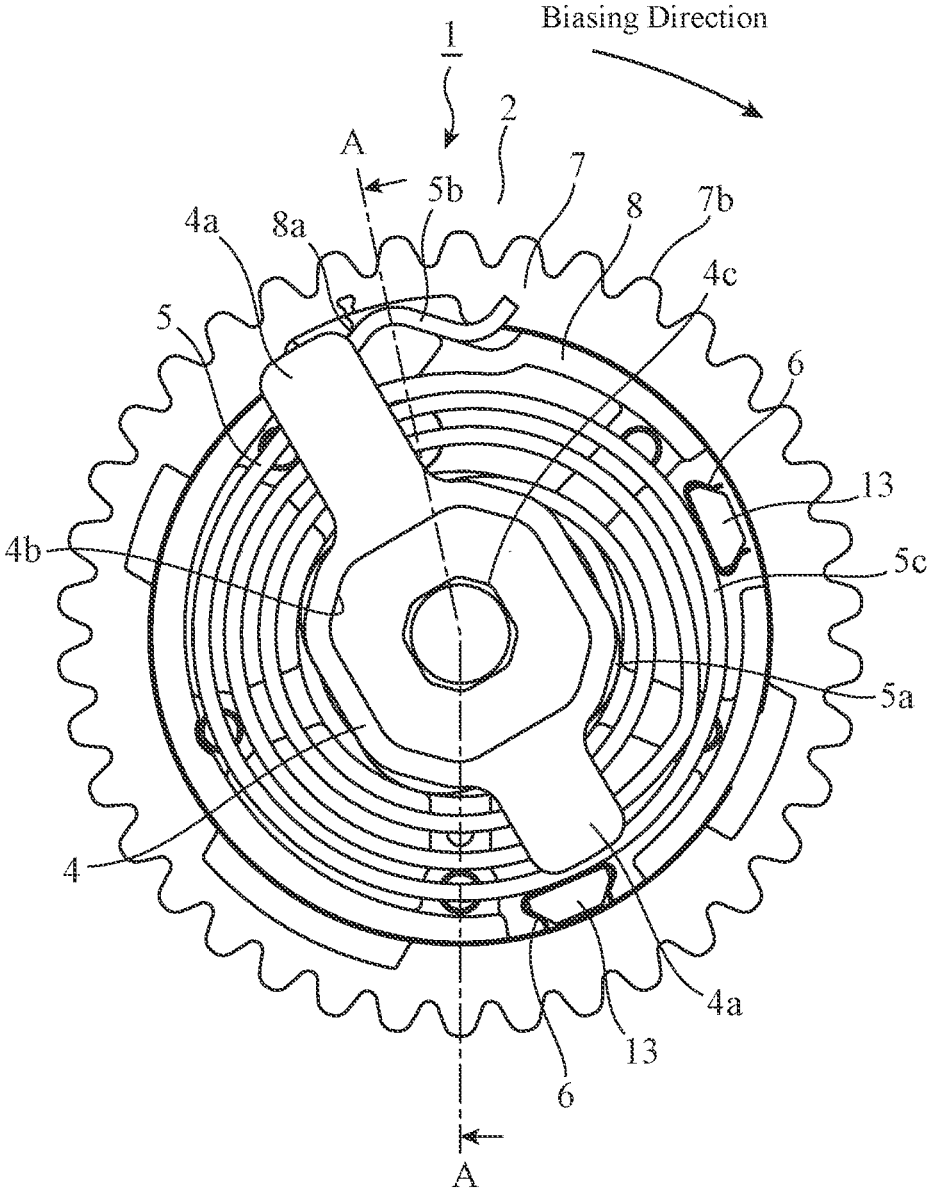
FIG. 1 is a plan view illustrating an example of a structure of a valve timing adjustment device according to a first embodiment.
Figure 2:
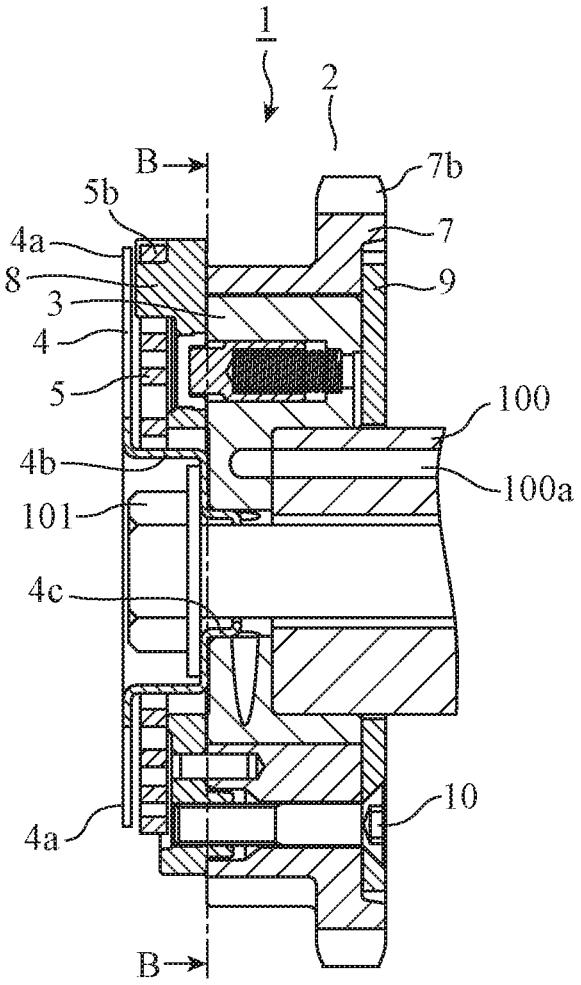
FIG. 2 is a cross-sectional view of the valve timing adjustment device according to the first embodiment taken along line A-A in FIG. 1.
Figure 3:
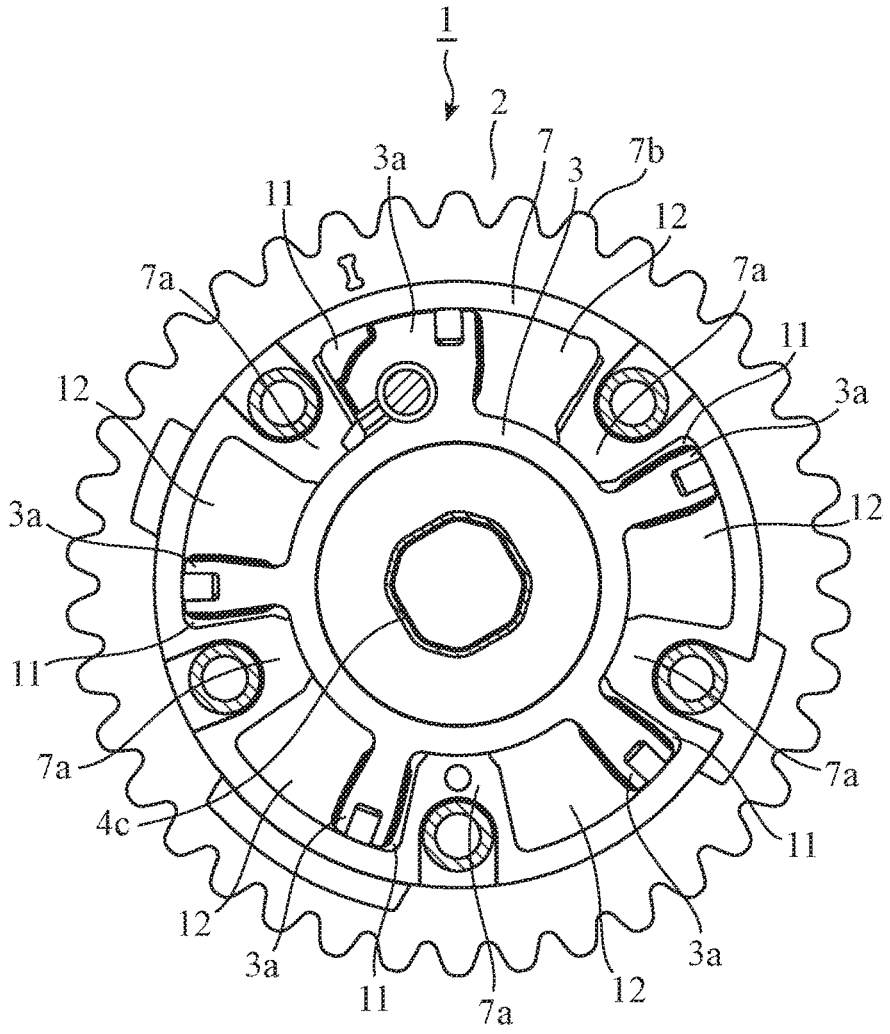
FIG. 3 is a cross-sectional view of the valve timing adjustment device according to the first embodiment taken along line B-B in FIG. 2.

FIG. 1 is a plan view illustrating an example of a structure of a valve timing adjustment device 1 according to a first embodiment. FIG. 2 is a cross-sectional view of the valve timing adjustment device 1 according to the first embodiment taken along line A-A in FIG. 1. FIG. 3 is a cross-sectional view of the valve timing adjustment device 1 according to the first embodiment taken along line B-B in FIG. 2.

As a basic structure, the valve timing adjustment device 1 includes: a first rotary body including hydraulic chambers; a second rotary body including vanes 3*a*, each of which partitions the corresponding hydraulic chamber into an advancing hydraulic chamber 11 and a retarding hydraulic chamber 12, and being rotatable relative to the first rotary body; a spiral spring 5 for biasing the second rotary body in one direction with respect to the first rotary body; projections 13 for stopping radially outward expansion of an outermost winding 5*c* of the spiral spring 5; and clips 6 attached to the projections 13 by their elastic force, and coming in contact with the outermost winding 5*c* of the spiral spring 5. The first rotary body is a housing 2 including a case 7, a plate 8, and a cover 9. The second rotary body is a rotor 3.

A sprocket portion 7*b* is formed on an outer face of the case 7. A chain, which is not illustrated, is mounted on the sprocket portion 7*b*, and thereby driving force from a crankshaft of an internal combustion engine is transmitted to the case 7. The driving force causes the housing 2 to rotate in synchronization with the crankshaft. In addition, the rotor 3 and a holder 4 are fastened to a camshaft 100 of the internal combustion engine with a central bolt 101, and thus rotate in synchronization with the camshaft 100.

The case 7 and the cover 9 have holes into which bolts 10 are inserted, and the plate 8 has internal threads into which the bolts 10 are screwed. The case 7, the plate 8, and the cover 9 are coaxially fixed by the bolts 10 in a state in which the case 7 and the rotor 3 are sandwiched between the plate 8 and the cover 9.

A plurality of shoe portions 7*a* protruding inward are formed on an inner face of the case 7. Spaces each of which is surrounded by the shoe portions 7*a*, the plate 8, and the cover 9 are the hydraulic chambers. In the example structure shown in FIG. 3, five hydraulic chambers are present. The rotor 3 is located inside the case 7. The rotor 3 has the vanes 3*a* protruding outward. The vanes 3*a* are provided in the respective hydraulic chambers in the case 7. One vane 3*a* partitions one hydraulic chamber into an advancing hydraulic chamber 11 and a retarding hydraulic chamber 12.

Hydraulic fluid is supplied to the advancing hydraulic chambers 11 or the retarding hydraulic chambers 12 via a hydraulic passage 100*a* formed inside the camshaft 100 and the rotor 3, which causes the rotor 3 to rotate relative to the housing 2, so that the angle of the rotor 3 relative to the housing 2 is adjusted to the advancing side or the retarding side. When the angle of the rotor 3 relative to the housing 2 is adjusted, the rotational phase of the camshaft 100 with respect to the crankshaft changes to the advancing side or the retarding side, and thus opening and closing timing of an inlet valve or an outlet valve also changes.

The spiral spring 5 biases the rotor 3 to the advancing side with respect to the housing 2 against reaction force applied to the camshaft 100 from the inlet valve or the outlet valve. The spiral spring 5 is a rectangular wire wound horizontally, and is fixed to the rotor 3 and the plate 8 of the housing 2 by the holder 4. Flange portions 4*a*, a cylindrical portion 4*b*, and a hole portion 4*c* of the holder 4 are formed of a steel plate by press working. An inner circumferential end 5*a* of the spiral spring 5 is engaged with an outer face of the cylindrical portion 4*b*, so that the inner circumferential end 5*a* of the spiral spring 5 is fixed to the holder 4 and thus is connected to the rotor 3. An outer circumferential end 5*b* of the spiral spring 5 is engaged with a groove 8*a* of the plate 8, so that the outer circumferential end 5*b* of the spiral spring 5 is fixed to the plate 8. Two flange portions 4*a* each have a shape extending in the radial direction of the spiral spring 5. In a case where a load is applied to the spiral spring 5 in a direction in which the spiral spring 5 drops off the holder 4 owing to vibration of a vehicle or the like, the flange portions 4*a* prevents the spiral spring 5 from dropping off. The hole portion 4*c* of the holder 4 is a hole through which the central bolt 101 for fastening the holder 4 to the camshaft 100 is inserted.

The projections 13 for stopping radially outward expansion of the outermost winding 5*c* of the spiral spring 5 are formed on an outer circumferential portion of the plate 8. The projections 13 protrude from the plate 8 toward the holder 4. In addition, the clips 6 are attached to the projections 13. The clips 6 are elastic members each of which is formed of a steel plate by press working, and are attached to the projections 13 by their elastic force. The projections 13 do not come in direct contact with the outermost winding 5*c* of the spiral spring 5, but the clips 6 come in direct contact therewith. At gentle and flat faces of the clips 6, the clips 6 come in contact with the outermost winding 5*c*, which can slow the progression of wear of the spiral spring 5 as compared with line contact such as that made by columnar pins. When the spiral spring 5 is worn out, the torque of the spiral spring 5 is lowered and breakage of the spiral spring 5 occurs. When projections 13 without the clips 6 come in contact with the outermost winding 5*c* and the wear of projections 13 thus progresses, the projections 13 and the outermost winding 5*c* do not come in contact with each other, and thereby the resonance frequency of the spiral spring 5 becomes lower. Thus, the spiral spring 5 resonates, and thus breakage thereof occurs. The clips 6 provided between the projections 13 and the outermost winding 5*c* of the spiral spring 5 can prevent the above.

While two projections 13 are formed at two positions on the outer circumferential portion of the plate 8 in the example structure shown in FIG. 1, the number and the positions of the projections 13 are not limited to those in the example structure shown in FIG. 1.

Next, details of the projections 13 and the clips 6 will be described.

Figure 4:
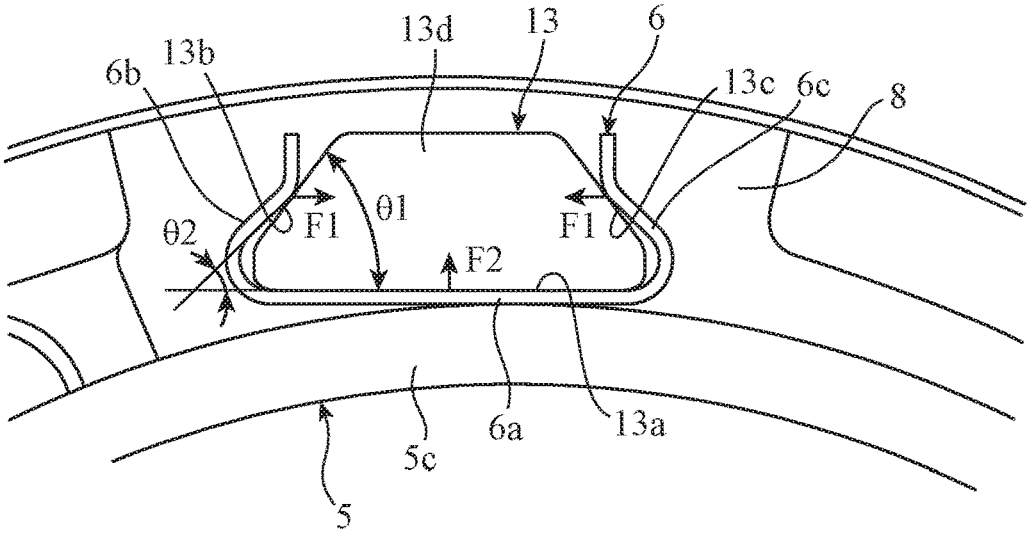
FIG. 4 is an enlarged view of a projection and a clip in FIG. 1.

FIG. 4 is an enlarged view of the projection 13 and the clip 6 in FIG. 1. The projection 13 has a first wall face 13*a* facing toward the outermost winding 5*c* of the spiral spring 5, and a second wall face 13*b* and a third wall face 13*c* continuous with respective sides of the first wall face 13*a*. The angle θ1 between the first wall face 13*a* and the second wall face 13*b* is an acute angle. In a similar manner, the angle between the first wall face 13*a* and the third wall face 13*c* is also an acute angle. An end face 13*d* of the projection 13 has a trapezoidal shape.

The clip 6 has a first portion 6*a* coming in contact with the outermost winding 5*c* of the spiral spring 5, and a second portion 6*b* and a third portion 6*c* continuous with respective sides of the first portion 6*a*. The first portion 6*a* of the clip 6 is in contact with the first wall face 13*a* of the projection 13, the second portion 6*b* of the clip 6 is in contact with the second wall face 13*b* of the projection 13, and the third portion 6*c* of the clip 6 is in contact with the third wall face 13*c* of the projection 13. The angle θ2 between the first portion 6*a* and the second portion 6*b* is an acute angle. In a similar manner, the angle between the first portion 6*a* and the third portion 6*c* is also an acute angle. Note that the angle θ2 is an acute angle smaller than the angle θ1. Loads generated when the second portion 6*b* and the third portion 6*c* of the clip 6 grip the second wall face 13*b* and the third wall face 13*c* of the projection 13 cause the clip 6 to be attached to the projection 13.

The angle θ1 of the projection 13 is an acute angle. Thus, in a case where the loads F1 generated when the clip 6 grips the projection 13 are applied, sliding force F2 in the upward direction in FIG. 4 acts on the clip 6. The action of the sliding force F2 causes the clip 6 to be attached at a position where the first wall face 13*a* of the projection 13 and the first portion 6*a* of the clip 6 come in contact with each other. In addition, because the angle θ2 of the clip 6 is an acute angle smaller than the angle θ1 of the projection 13, the clip 6 and the projection 13 can surely come in contact with each other at the second portion 6*b* and the second wall face 13*b* and at the third portion 6*c* and the third wall face 13*c*. Furthermore, because the angle θ2 of the clip 6 is an acute angle smaller than the angle θ1 of the projection 13, the sliding force F2 becomes great, and the first wall face 13*a* of the projection 13 and the first portion 6*a* of the clip 6 can thus surely come in contact with each other. As described above, the three wall faces of the projection 13 come in contact with the respective three faces of the clip 6, which makes the clip 6 less likely to be shifted and fall off after being attached to the projection 13.

The material of the clips 6 is harder than the plate 8 on which the projections 13 are formed and softer than the spiral spring 5. The material of the clips 6 is stainless steel, for example, such as SUS631-CSP3/4H specified by Japanese Industrial Standards (JIS). The material of the plate 8 is an aluminum alloy, for example, such as ADC12 specified by JIS. The material of the spiral spring 5 is piano wire, for example, such as SWP-B specified by JIS. Because material harder than the plate 8 is used for the clips 6, the progression of wear of the clips 6 is prevented, and thus the situation where the spiral spring 5 and the clips 6 do not come in contact with each other is prevented. In addition, because material softer than the spiral spring 5 is used for the clips 6, the wear of the spiral spring 5 is reduced, and thus the decrease in torque and the breakage are prevented.

Next, a method of attaching the clip 6 will be explained.

Figure 5:
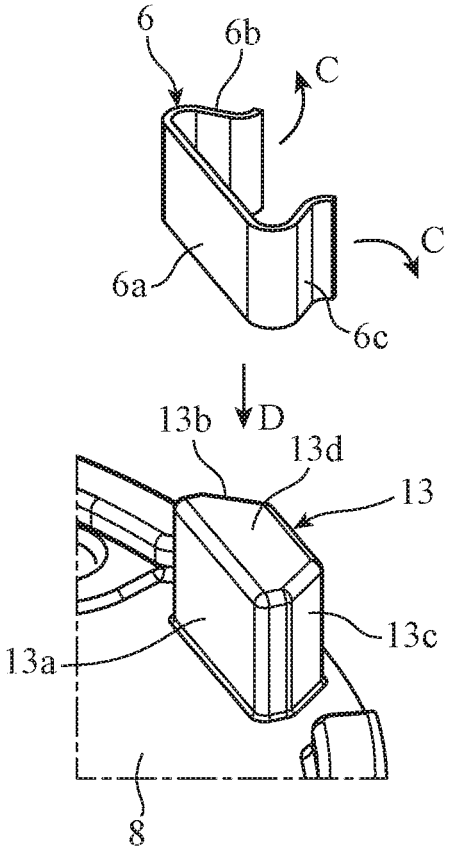
FIG. 5 is a perspective view illustrating a state before the clip is attached to the projection in the first embodiment.
Figure 6:
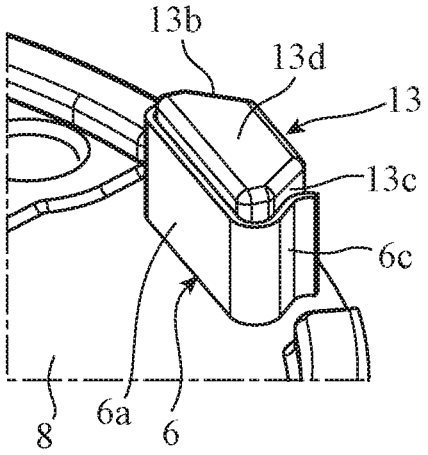
FIG. 6 is a perspective view illustrating a state in which the clip is attached to the projection in the first embodiment.

FIG. 5 is a perspective view illustrating a state before the clip 6 is attached to the projection 13 in the first embodiment. FIG. 6 is a perspective view illustrating a state in which the clip 6 is attached to the projection 13 in the first embodiment.

As illustrated in FIG. 5, a worker opens the second portion 6*b* and the third portion 6*c* of the clip 6 in the directions indicated by arrows C into a state in which the first portion 6*a* is bent within the elastic range. The worker moves the clip 6 in this state in the direction indicated by arrow D to fit the clip 6 onto the projection 13. As illustrated in FIG. 6, the clip 6 is attached to the projection 13 by its elastic force. Because the clip 6 moves in the direction indicated by arrow D, that is, a direction perpendicular to the end face 13*d* of the projection 13, to fit onto the projection 13, the clip 6 can be attached with a minimum amount of bending. Thus, plastic deformation of the clip 6 can be prevented.

Note that a retaining portion may be provided on the projection 13 to prevent the clip 6 from falling off the projection 13.

Figure 7:
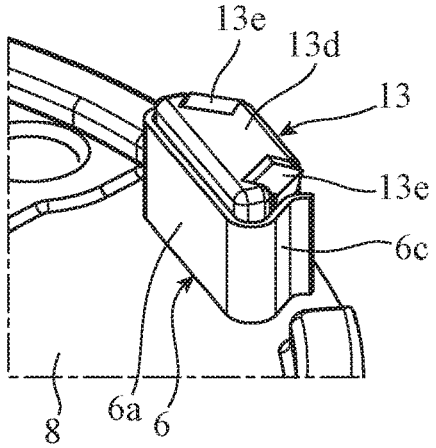
FIG. 7 is a perspective view illustrating an example of retaining portions formed on the projection of the first embodiment.
Figure 8:
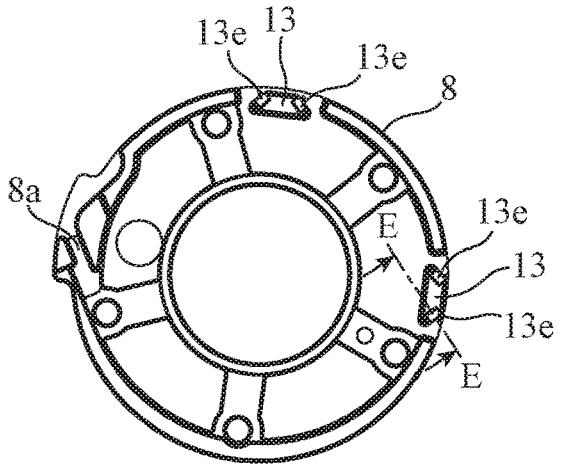
FIG. 8 is a plan view of a plate of the first embodiment.
Figure 9:
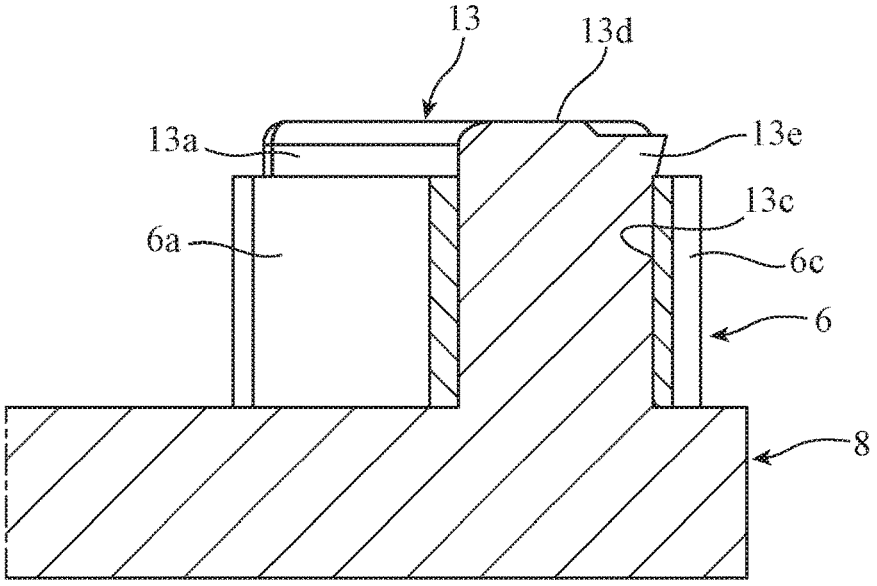
FIG. 9 is a cross-sectional view of the projection of the first embodiment taken along line E-E in FIG. 8.

FIG. 7 is a perspective view illustrating an example of retaining portions 13*e* formed on the projection 13 of the first embodiment. FIG. 8 is a plan view of the plate 8 of the first embodiment. FIG. 9 is a cross-sectional view of the projection 13 of the first embodiment taken along line E-E in FIG. 8.

After the clip 6 is attached, the end face 13*d* of the projection 13 is swaged, so that burrs are formed. The burrs function as the retaining portions 13*e* that prevent the clip 6 from falling off. For example, edge sides of the end face 13*d* of the projection 13 are swaged to form the retaining portions 13*e*, the edge sides corresponding to the points to which the loads F1 from the clip 6 are applied. Because the points to which the loads F1 are applied are positions where the clip 6 and the projection 13 are surely in contact with each other, the retaining portions 13*e* formed at these positions can reliably prevent the clip 6 from falling off the projection 13.

While the retaining portions 13*e* are formed on the second wall face 13*b* and the third wall face 13*c* in the example structure shown in FIGS. 7 to 9, a retaining portion 13*e* may be formed on the first wall face 13*a*.

In addition, the retaining portions 13*e* may be formed in a manner other than swaging.

Figure 10:
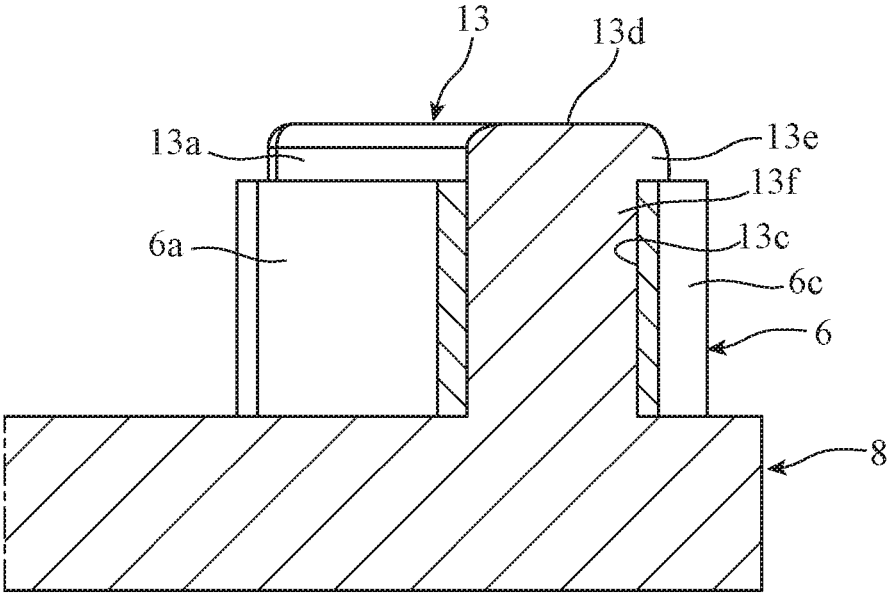
FIG. 10 is a cross-sectional view of a projection taken along line E-E in FIG. 8, illustrating a modification of the retaining portion of the first embodiment.

FIG. 10 is a cross-sectional view of a projection 13 taken along line E-E in FIG. 8, illustrating a modification of the retaining portion 13*e* of the first embodiment. In the modification shown in FIG. 10, a recess 13*f* into which the third portion 6*c* of the clip 6 is fitted is formed on the third wall face 13*c* of the projection 13, and a ledge portion at the top of the recess 13*f* functions as a retaining portion 13*e*. A recess 13*f* and a retaining portion 13*e* having a structure similar to the above may also be formed on the second wall face 13*b* or the first wall face 13*a* of the projection 13 in addition to the third wall face 13*c*.

As described above, the valve timing adjustment device 1 according to the first embodiment includes: the housing 2 including hydraulic chambers; the rotor 3 including vanes 3*a*, each of which partitions the corresponding hydraulic chamber into the advancing hydraulic chamber 11 and the retarding hydraulic chamber 12, and being rotatable relative to the housing 2; the spiral spring 5 having the outer circumferential end 5*b* fixed to the plate 8 of the housing 2 and the inner circumferential end 5*a* fixed to the rotor 3 by the holder 4, for biasing the rotor 3 in one direction with respect to the housing 2; the projections 13 protruded from the plate 8 of the housing 2, for stopping radially outward expansion of the outermost winding 5*c* of the spiral spring 5; and the clips 6 having the first portions 6*a* coming in contact with the outermost winding 5*c* of the spiral spring 5, and being attached to the projections 13 by their elastic force. Because the first portions 6*a* of the clips 6, instead of the projections 13, come in contact with the outermost winding 5*c*, wear of the spiral spring 5 and the projections 13 can be reduced.

In addition, the projections 13 of the first embodiment each have the first wall face 13*a* facing toward the outermost winding 5*c* of the spiral spring 5, and the second wall face 13*b* and the third wall face 13*c* continuous with respective sides of the first wall face 13*a*, the angle θ1 between the first wall face 13*a* and the second wall face 13*b* and the angle θ1 between the first wall face 13*a* and the third wall face 13*c* being acute angles. The clips 6 each have the first portion 6*a* coming in contact with the outermost winding 5*c* of the spiral spring 5, and the second portion 6*b* and the third portion 6*c* continuous with respective sides of the first portion 6*a*, the angle θ2 between the first portion 6*a* and the second portion 6*b* and the angle θ2 between the first portion 6*a* and the third portion 6*c* are acute angles smaller than the angles θ1 mentioned above. Thus, the loads F1 and the sliding force F2 as illustrated in FIG. 4 are applied, which make the clips 6 less likely to be shifted and fall off after being attached to the projections 13.

In addition, the material of the clips 6 of the first embodiment is harder than the plate 8 of the housing 2 and softer than the spiral spring 5. For example, the clips 6 are made of stainless steel, the plate 8 is made of aluminum alloy, and the spiral spring 5 is made of piano wire. As a result, wear of the clips 6 and the spiral spring 5 can be reduced.

In addition, the projections 13 of the first embodiment have the retaining portions 13*e* for preventing the clips 6 from falling off. The retaining portions 13*e* include swaged portions of the projections 13, for example. The retaining portions 13*e* reliably prevent the clips 6 from falling off.

Note that any component in the embodiment of the present invention can be modified, and any component in the embodiment can be omitted within the scope of the invention.

For example, the valve timing adjustment device 1 according to the first embodiment may be used on the inlet side, and may be used on the outlet side. In addition, the biasing direction of the spiral spring 5 may be the advancing direction, and may be the retarding direction. In addition, because the structures of the projections 13 and the clips 6 of the first embodiment do not affect the internal structure of the valve timing adjustment device 1, the structures of the projections 13 and the clips 6 of the first embodiment are also applicable to devices other than the valve timing adjustment device 1 having the internal structure as illustrated.

INDUSTRIAL APPLICABILITY

A valve timing adjustment device according to the present invention is suitable for use as a valve timing adjustment device for adjusting opening and closing timing of an inlet valve or an outlet valve of an internal combustion engine.

REFERENCE SIGNS LIST

1: Valve timing adjustment device, 2: Housing (first rotary body), 3: Rotor (second rotary body), 3*a*: Vane, 4: Holder, 4*a*: Flange portion, 4*b*: Cylindrical portion, 4*c*: Hole portion, 5: Spiral spring, 5*a*: Inner circumferential end, 5*b*: Outer circumferential end, 5*c*: Outermost winding, 6: Clip, 6*a*: First portion, 6*b*: Second portion, 6*c*: Third portion, 7: Case (first rotary body), 7*a*: Shoe portion, 7*b*: Sprocket portion, 8: Plate (first rotary body), 8*a*: Groove, 9: Cover (first rotary body), 10: Bolt, 11: Advancing hydraulic chamber, 12: Retarding hydraulic chamber, 13: Projection, 13*a*: First wall face, 13*b*: Second wall face, 13*c*: Third wall face, 13*d*: End face, 13*e*: Retaining portion, 13*f*: Recess, 100: Camshaft, 100*a*: Hydraulic passage, 101: Central bolt.

The invention claimed is:

1. A valve timing adjustment device that adjusts opening and closing timing of an inlet valve or an outlet valve of an internal combustion engine, the valve timing adjustment device comprising:

a first rotary body including hydraulic chambers;

a second rotary body having vanes each of which partitions a corresponding one of the hydraulic chambers into an advancing side and a retarding side, the second rotary body being rotatable relative to the first rotary body;

a spiral spring having one end fixed to the second rotary body and another end fixed to the first rotary body, the spiral spring being configured to bias the second rotary body in one direction with respect to the first rotary body;

a projection protruded from the first rotary body, the projection being configured to stop radially outward expansion of an outermost winding of the spiral spring; and a clip having a first portion coming in contact with the outermost winding of the spiral spring, the clip being attached to the projection by an elastic force of the clip, wherein the projection has a first wall face facing toward the outermost winding of the spiral spring, and a second wall face and a third wall face continuous with respective sides of the first wall face, an angle between the first wall face and the second wall face and an angle between the first wall face and the third wall face being acute angles, and the clip has the first portion coming in contact with the outermost winding of the spiral spring, and a second portion and a third portion continuous with respective sides of the first portion, an angle between the first portion and the second portion being an acute angle smaller than the angle between the first wall face and the second wall face, an angle between the first portion and the third portion being an acute angle smaller than the angle between the first wall face and the third wall face.

2. The valve timing adjustment device according to claim 1, wherein the projection includes a retaining portion for preventing the clip from falling off.

3. The valve timing adjustment device according to claim 2, wherein the retaining portion includes a swaged portion of the projection.

4. A valve timing adjustment device that adjusts opening and closing timing of an inlet valve or an outlet valve of an internal combustion engine, the valve timing adjustment device comprising:

a first rotary body including hydraulic chambers;

a second rotary body having vanes each of which partitions a corresponding one of the hydraulic chambers into an advancing side and a retarding side, the second rotary body being rotatable relative to the first rotary body;

a spiral spring having one end fixed to the second rotary body and another end fixed to the first rotary body, the spiral spring being configured to bias the second rotary body in one direction with respect to the first rotary body;

a projection protruded from the first rotary body, the projection being configured to stop radially outward expansion of an outermost winding of the spiral spring; and a clip having a first portion coming in contact with the outermost winding of the spiral spring, the clip being attached to the projection by an elastic force of the clip, wherein the clip is made of a material of the clip is harder than the first rotary body and softer than the spiral spring.

5. The valve timing adjustment device according to claim 4, wherein the projection includes a retaining portion for preventing the clip from falling off.

6. The valve timing adjustment device according to claim 5, wherein the retaining portion includes a swaged portion of the projection.

7. A valve timing adjustment device that adjusts opening and closing timing of an inlet valve or an outlet valve of an internal combustion engine, the valve timing adjustment device comprising:

a first rotary body including hydraulic chambers;

a second rotary body having vanes each of which partitions a corresponding one of the hydraulic chambers into an advancing side and a retarding side, the second rotary body being rotatable relative to the first rotary body;

a spiral spring having one end fixed to the second rotary body and another end fixed to the first rotary body, the spiral spring being configured to bias the second rotary body in one direction with respect to the first rotary body;

a projection protruded from the first rotary body, the projection being configured to stop radially outward expansion of an outermost winding of the spiral spring; and a clip having a first portion coming in contact with the outermost winding of the spiral spring, the clip being attached to the projection by an elastic force of the clip, wherein the clip is made of stainless steel, the first rotary body is made of aluminum alloy, and the spiral spring is made of piano wire.

8. The valve timing adjustment device according to claim 7, wherein the projection includes a retaining portion for preventing the clip from falling off.

9. The valve timing adjustment device according to claim 8, wherein the retaining portion includes a swaged portion of the projection.

* * * * *